United States Patent [19]

Cox et al.

[11] 4,432,669

[45] Feb. 21, 1984

[54] ICE ISLAND CONSTRUCTION

[75] Inventors: Gordon F. N. Cox, Lyme Center, N.H.; Kenneth G. Nolte, Tulsa, Okla.

[73] Assignee: Standard Oil Company (Indiana), Chicago, Ill.

[21] Appl. No.: 233,353

[22] Filed: Feb. 11, 1981

[51] Int. Cl.[3] ..... E02B 17/00

[52] U.S. Cl. ..... 405/217; 62/260; 405/61

[58] Field of Search ..... 405/217, 211, 270, 61; 62/259, 260; 404/27, 28, 71, 75, 78, 18

[56] References Cited

U.S. PATENT DOCUMENTS

| | | | |
|---|---|---|---|
| 2,737,092 | 3/1956 | Gramelspacher | 404/28 |
| 3,804,543 | 4/1974 | Best | 404/28 |
| 3,849,993 | 11/1974 | Robinson et al. | 405/217 |
| 4,094,149 | 6/1978 | Thompson et al. | 405/217 X |
| 4,205,928 | 6/1980 | Thompson et al. | 405/217 |
| 4,242,012 | 12/1980 | Utt | 405/217 |

*Primary Examiner*—Dennis L. Taylor

*Attorney, Agent, or Firm*—John D. Gassett

[57] ABSTRACT

An ice island is constructed in a marine area having a sheet of natural ice whereby, in a basic embodiment, a lower layer of fresh water ice is made by continually adding fresh water to the ice sheet and letting it freeze until the sheet is on bottom. An impervious insulating layer is put on top of the fresh ice and an upper layer is constructed thereon from sea water or mined ice blocks.

4 Claims, 5 Drawing Figures

ICE ISLAND CONSTRUCTION

RELATED APPLICATION

The subject method of this invention is similar to copending patent application Ser. No. 323,349, entitled "Ice Island Construction," filed 2/11/81 now U.S. Pat. No. 4,373,836, Gordon F. N. Cox and F. H. Hsu, inventors.

BRIEF SUMMARY OF THE INVENTION

This invention relates to ice island construction in marine areas covered by natural sea ice. In some parts of the United States off the coast of Alaska, sea ice, which may be up to six to seven feet in thickness, covers a large portion of the ocean immediately surrounding the shore area. This ice sheet may sometimes be attached to the surrounding beaches but more likely it will be mobile so that the ice sheet moves at a slow rate, e.g., two feet per day. Although this is a slow rate, the ice pack can exert considerable loads on offshore structures. A lot of the ice pack is over relatively shallow water, e.g., 20 feet and covers some of the geological structures which may contain petroleum. Thus, it is desirable to drill oil and gas wells in these areas. This can be done from fixed platforms by making an island out of gravel and the like. However, merely putting the drilling platform on steel piles is not normally satisfactory inasmuch as it is not always possible to build a pile-founded platform of sufficient strength to withstand the force of the moving ice. Other methods which have been suggested are the use of ice islands. The present invention is an improved method of construction of ice islands.

This covers a method of constructing an artificial ice island in a marine body covered at least partially by sheet ice. Natural and man-made sea ice is composed of sea ice crystals made up of pure ice, liquid brine inclusions, and solid salts. As the ice temperature or salinity increases, the ice brine volume increases via phase relationships. The greater the ice brine volume, the weaker the ice. Fresh water ice is also stronger than sea ice. Further, brine tends to migrate in ice from top to bottom, which weakens the bottom of the ice. In a basic embodiment we first prepare a lower layer of ice from fresh water. We apply fresh water to a confined area on top of the sheet ice the size we wish to make the ice island. We keep adding fresh water and let it freeze, which in turn causes the sheet ice beneath it to be forced lower and lower into the water until it contacts the bottom thereof. We continue this until the constructed fresh ice reaches the approximate level of the top of the sheet ice. Fresh water is used for the lower level because fresh water ice is much stronger than sea ice. Once the lower base is formed, which is the part that is subject to lateral ice loads and shearing action from the floating ice, we build up the upper layer using sea water. This is not as strong as the lower layer, but it does not need to be.

In another embodiment we construct the ice island by first making a lower level of ice by adding water to the top of the sheet of ice in the selected area until the ice touches the bottom of the body of water. The island is allowed to cool. An insulation material is then added to the top of the lower level of ice. This insulation is then covered with a layer that is impervious to water. This impervious layer may be on the lower side of the insulation. After the insulation and the impervious layer have been made, we then make an upper level of ice over the selected island area. The upper level can be made out of sea water and if some of the brine should seep downwardly from the upper level, it can not penetrate into the lower level and weaken it. We can also make the upper layer out of ice blocks which are cut from the surrounding floating ice sheet.

In what may be our preferred embodiment for constructing an artificial ice island, we first construct a lower level by flooding an area selected for the island site and as the first amount of water freezes we keep adding water and it keeps freezing until the sheet ice on which the ice is built up sinks to the bottom. We then allow time for this constructed ice to cool. In the meantime we mine blocks of ice from natural ice sheets in the surrounding area. We then cool these mined blocks by stacking or storing them such that the air has contact with most of the surface of the ice block. Inasmuch as the ice blocks are relatively small, e.g., $2\times4\times6$ feet, the blocks will rapidly approach the ambient temperature. We then place the blocks on the selected ice island area, which is the lower level established. We then freeze the ice blocks together.

A better understanding of the invention can be had from the following description taken in conjunction with the drawings.

DRAWINGS

Figure 3:
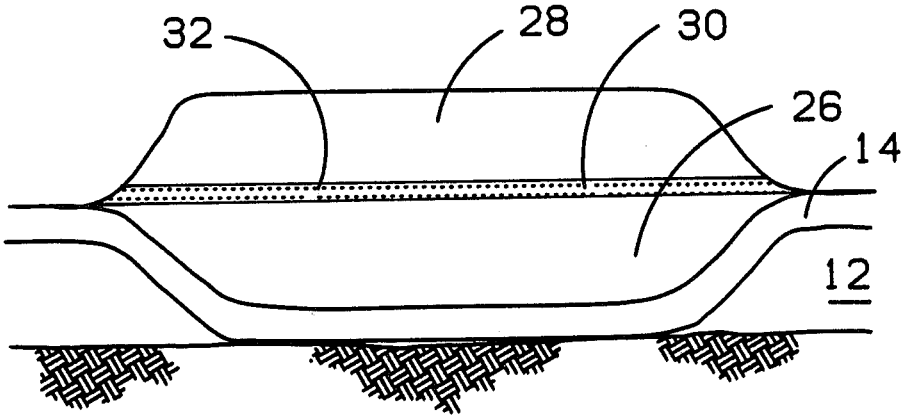

FIG. 3 also has different vertical and horizontal scales and illustrates an artificial ice island in which an impervious insulation layer separates a lower constructed ice layer from an upper constructed ice layer, and made on a nautral ice sheet.

Figure 4:
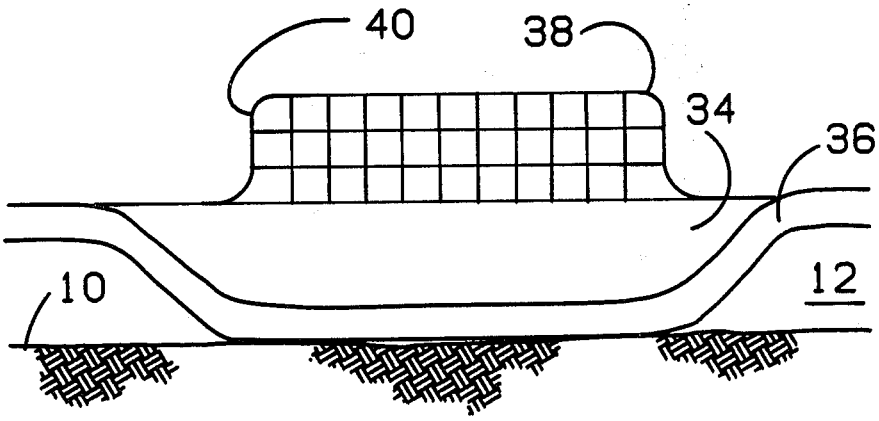

FIG. 4 also has different vertical and horizontal sinks and illustrates an artificial ice island in which an upper layer is made of mined ice blocks which is supported by flooded ice constructed on top of a natural sheet ice.

Figure 5:
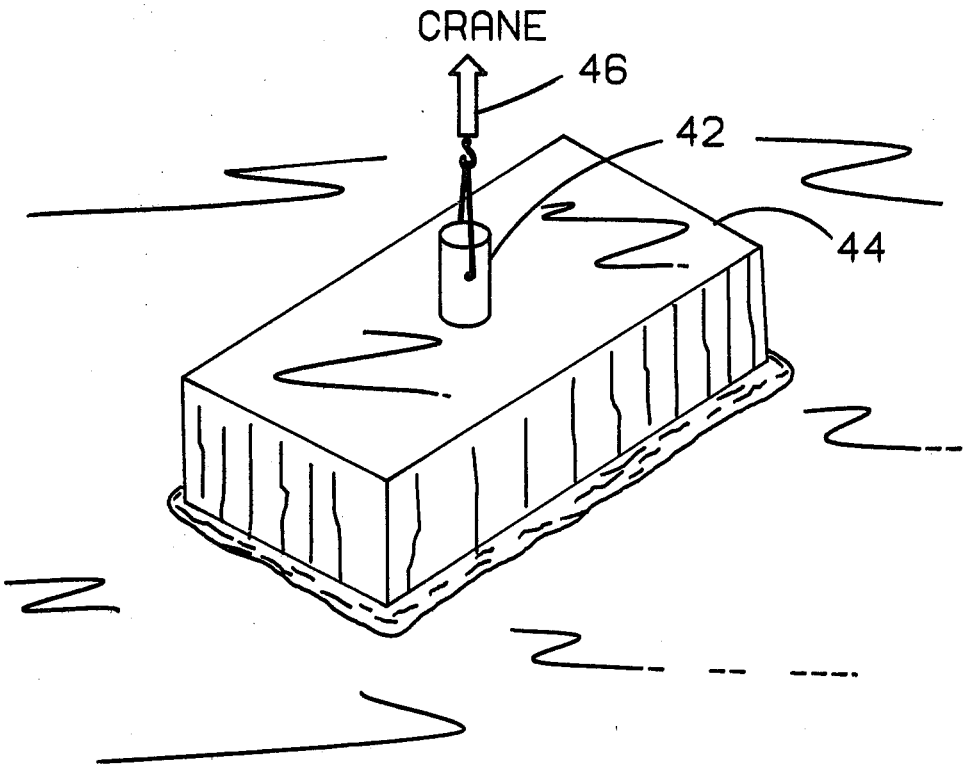

FIG. 5 illustrates lifting the first ice block from an ice sheet.

DETAILED DESCRIPTION OF THE INVENTION

Figure 1:
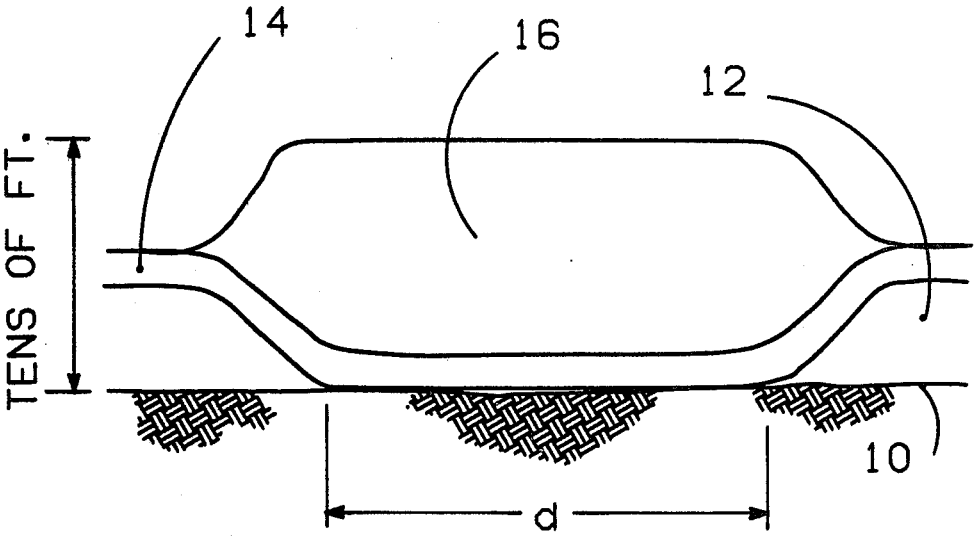
FIG. 1 illustrates a large diameter ice island, with different vertical and horizontal scales, made by constructed ice on top of a natural ice sheet.

In addition to requiring adequate ice strength to resist ice movement, an ice island must have sufficient sliding resistance on the sea floor. This is accomplished by making the island large enough so that the contact area and weight of the island produces the required sliding resistance. Islands on the order of 300 feet in diameter and 50 feet thick have been considered in the public literature. We proposed larger diameter and smaller thickness ice islands be constructed when using construction techniques which result in a warm saline ice, e.g. just slightly below freezing. As shown in FIG. 1, an ice island has been made on an area having a sea floor 10, sea water 12, a natural ice sheet 14, and constructed ice 16. This ice island can be constructed by flooding the area on top of ice sheet 14 on which it is desired to produce the ice island. The water is confined to the selected area where it freezes and additional water is continually added until the constructed ice is of the desired thickness. As can be seen in FIG. 1, the weight of the constructed ice 16 deforms the layer of the natural ice 14 until eventually it rests on the bottom 10. The diameter of our large ice island is at least 1000 to 2000 feet wide. Large diameter ice islands have two distinct advantages over smaller diameter and thicker islands. First, as the build-up rate of these techniques is determined by the weather conditions, only a limited thickness of ice can be constructed each day. By designing a larger diameter ice island, the required island thickness to resist ice movement is reduced and the island can be constructed and ready for drilling sooner. The final thickness of the island is limited by the growth rate and time available before drilling; however, the island diameter only depends on the number of pumps, etc., that are available. Second, and equally important, thinner ice islands cool faster. It is to be noted that the ice islands are constructed when the ambient temperature is normally much colder than the sea water. In fact, it is preferred that the ambient temperature be −25° C. or colder when the ice islands are constructed. In any event, the ambient temperature has to be lower than the freezing point of the water used. It is necessary for the warm, constructed ice to cool to have adequate strength to resist internal shear. As the thermal conductivity of ice is low, thick ice islands do not have sufficient time to cool at depth before drilling must begin. The lower portions of the thick islands, e.g., 50 feet or more, remain warm and would fail when the surrounding sea ice moves. Thus, by increasing the island diameter, the required island thickness is reduced, thereby decreasing the construction time as well as permitting more cooling with resulting ice strength.

Figure 2:
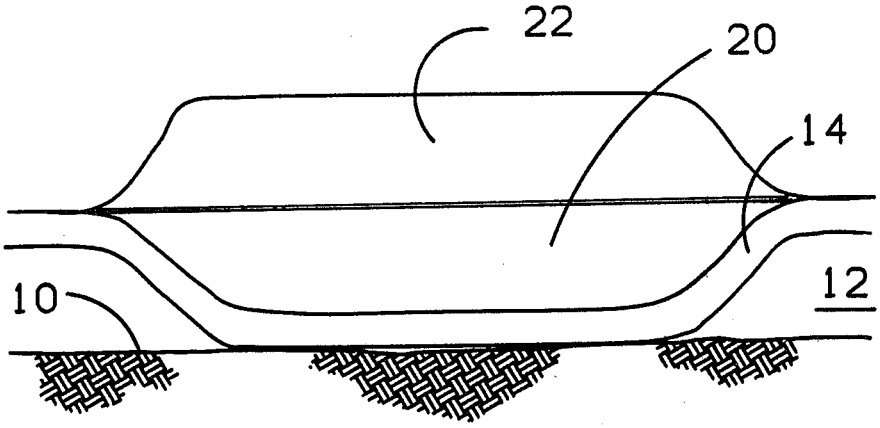
FIG. 2 shows an artificial ice island in which a lower level is made of fresh-water-constructed ice and the upper is made of a saline-constructed ice, again the vertical scale is different from the horizontal.

Attention is next directed to FIG. 2 for an illustration of what we can call our fresh water/sea water ice island. The strength of the constructed ice may be increased by decreasing the ice salinity. This may be accomplished by using lower salinity water during construction; however, we prefer to use freah water. As seen in FIG. 2, there are two layers of constructed ice; a lower layer 20 is a fresh-water-constructed ice and the upper layer 22 is a saline-constructed ice. By using the fresh water to prepare the lower layer 20, we greatly increase the strength of the ice. It is this lower layer 20 which must resist the internal shear forces caused by movement of the surrounding ice sheet 14. It is noted that the lower constructed ice layer 20 is built up until its top is at least equal to the heigth of the natural ice sheet 14. The ice island above this level is not subjected to the severe shear forces and thus the upper constructed ice layer 22 can be made by using sea water. The fresh or low salinity water may be transported from nearby lakes or rivers by trucks or pipelines or produced on-site by desalinization of sea water. As fresh water is more difficult to obtain than sea water, only the lower portion of the ice island which is susceptible to shear forces needs to be constructed with the fresh water. Should low salinity water be used for construction, an upper bound for the water salinity will depend on the temperature and salinity of the constructed ice during drilling, as these parameters govern the ice strength. For a discussion of ice strength and salinity of the water, reference is made to Schwarz, J. and Weeks, W. F. (1977), Engineering Properties of Sea Ice, Journal of Glaciology, Vol. 19, no. 81, p. 499–531.

Attention is next directed to FIG. 3 which shows an ice island with an insulation layer. For a given ice island diameter, the thickness required to resist ice movement increases with water depth. It is therefore a problem to construct even large diameter ice islands in deeper waters to resist ice movement because they do not have enough time to cool at depth. That is, the lower portion of the constructed ice island can not cool sufficiently to have the required strength. If sufficient time is not available for a thick ice island to cool before drilling, we teach the following method, which uses an insulation layer. The lower portion or constructed ice layer 26 is constructed by flooding until the island has grounded on the sea floor 10. This portion is then allowed to cool until it has cooled enough to have adequate strength to resist ice movement. This can be determined by placing a thermocouple in the constructed ice and observing the temperature. Once the constructed ice layer 26 has cooled to the desired temperature, an insulation layer 32 is placed on the constructed ice layer 26 to protect it from warming which would have occurred after construction is resumed to build up the upper part of the ice island. It is also preferred to place an impervious layer or sheet 32 over the insulation to prevent brine from the overlying warm ice 28 to drain to the lower portion of the ice island and cause ice deterioration. After we place insulation layer 30 and impervious layer 32 over the constructed ice 26, construction is continued as quickly as possible on the upper constructed ice layer 28 until the required island thickness is obtained. A particularly preferred method of constructing the configuration ice island illustrated in FIG. 3 is to make the constructed ice layer 26 from fresh water. This will result in a high-strength, shear-resistant island which is insulated from the newly constructed ice layer 28. The method prevents concentrated brine from the constructed layer 28 from penetrating and weakening the constructed ice layer 26.

It is desirable that insulation 30 be composed of a material that would not have to be retrieved after the ice island had served its purpose such as for a base for drilling operations. Wood chips have been used in the arctic for insulation and should be an environmentally safe material. This procedure of FIG. 3 has an advantage over continuous repeated floodings until the final thickness has been obtained in that by using the insulation it is not required to cool the upper layer 28 to the coldness required for the strength of the lower part of the island. Only the lower portion, which must have adequate ice strength to resist ice movement, is cooled to this degree. Construction time plus cooling time for a competent island is therefore substantially reduced. Once the insulation has been positioned on the constructed ice layer 26, other construction techniques which produce a weaker ice at a faster build-up rate may be used to build up the rest of the island. Above the level of the natural ice sheet the constructed ice strength is not critical since the ice in the upper portion does not have to resist internal shear caused by ice movement. For example, flooding snow to produce snow ice, which is weaker than flooded ice, may be used to build up the rest of the island, that is, layer 28, at a faster rate.

Attention is next directed to FIG. 4 which shows a combination flooded ice, ice block island. In the construction of the ice block island illustrated in FIG. 4 the lower flooded ice layer 34 built on natural ice 36 is constructed similarly as described for FIGS. 2 and 3. In order to build the upper layer we utilize a technique using ice blocks 38 to make up the upper layer 40. Ice blocks 38 are mined from the surrounding natural ice sheet 36. In this method the lower flooded ice level 34 is built up until the island has grounded on sea floor 10. Then the flooded ice is allowed to cool until the ice has adequate strength to resist internal shear caused by ice movement. At the same time that the flooded ice layer 34 is being built and cooled, blocks of ice are mined from the natural ice sheet. The cut ice blocks are cured by placing them such that air can circulate on all sides to cool them to approach ambient temperature. This can be done by placing the blocks on slats so that the cold air can surround and contact most of the exterior surface of the ice block. This ice island will probably be constructed when the ambient temperature is −25° C. or colder. By cutting blocks small enough, e.g., 2×4×6 feet, they can be cooled rather quickly. By decreasing the ice block temperature we increase the ice strength and the blocks also lose concentrated brine which otherwise might later cause ice deterioration. When the ice blocks have reached approximately the ambient temperature throughout and have lost their excess brine, they may be called "cured" ice blocks. The cured ice blocks are also more easily frozen together. After the flooded ice has cured or reached its desired temperature, layers of the cured ice blocks are placed on the flooded ice layer 34 and frozen together with sea water to construct the upper layer 40. Unlike the technique described in connection with FIG. 3, an insulation layer is not required over the lower flooded or constructed ice layer 34. This is because the ice blocks are colder than the underlying ice and acts as a heat sink. In addition to not needing an insulation layer, the build-up rate for the ice block method only depends on the amount of equipment on-site and is not limited by the weather conditions. Another advantage is that no impervious layer is needed beneath the ice blocks as they lose most of their brine while curing as explained hereinafter. Although not needed, the impervious and insulation layers can be used.

In the construction method as described above in connection with the previous FIGS. 2 to 4, the lower level of constructed ice was made by a flooding technique. Construction of an ice island from ice blocks mined from the natural sea sheet ice will now be discussed. There are four steps needed in the construction of an artificial ice island from mined ice blocks. They include mining, curing, transportation, and bonding. Mining the ice blocks from a natural ice sheet, such as 36 requires a snow plow, surveying equipment, several ice-cutting machines, such as a trencher, and a crane. Since uniform blocks are needed to construct the island, a survey crew first lays out lines on the ice to be cut by an ice trenching machine. Conditions may required that the snow be plowed off the ice surface. Once the cutting lines have been marked on the ice, such as by spray paint, the blocks are cut out by the trenching machine. The first block may be removed by coring a hole or holes in the block and freezing in a pipe with holes, a hook or eye bolt at the top end, such as illustrated in FIG. 5. The block 44 is lifted from the ice sheet using a crane with a cable 46 attached to the frozen bolt 42. Subsequent blocks may be removed by using a large bucket or ice tongs attached to the crane. If a 4×8 foot block is excavated from the 2 foot thick ice, a six-ton capacity crane would be required to lift the blocks. Ice cutting machines having cutting speeds up to 10 feet per minute in 4 to 6 foot thick ice have been tested by the Naval Civil Engineering Laboratory.

Once the ice blocks 44 have been excavated from the natural ice sheet, the blocks should be allowed to cure before they are used for construction. This may be accomplished by placing the ice blocks on beams or slatlike material with the natural top up until the lower portion of the block has reached the ambient temperature which may take several days, e.g., seven to ten. As the blocks cool, the concentrated brine in the ice will drain out by brine expulsion and gravity drainage. This decrease in ice temperature and salinity results in higher ice strength. Furthermore, the brine which has drained out of the ice blocks during the curing stage will not later accumulate at the base of the ice island by gravity drainage and cause ice deterioration. The colder temperature of the ice blocks will also facilitate welding them together and produce a stronger ice block bond.

Brine drainage may cause the underside of the ice blocks to be rough and irregular. It may therefore be necessary to turn the blocks over and position them upside down. The rough ice on top may be scraped off with a plow. Placing the blocks in this manner also allows the warmer lower portion of the ice blocks to cool more rapidly. After the blocks have cured, they must be transported and positioned at the construction site. Large payloaders equipped with a fork lift and crane may be used for this task.

The ice blocks are best boonded to the underlying ice, that is the top of the sheet ice on the specific area at which it is desired to build the ice island. Before the ice blocks are positioned, the ice surface is flooded with water and allowed to form a slush layer. The cured ice blocks are then placed on the slush and the excess water is quickly squeezed out and the slush freezes since the base of the ice blocks is at ambient temperature, −25° C. Vertical cracks between the blocks are then flooded with water. If it is found that the water runs out, as between large cracks, the cracks can be filled with saturated snow. The greater the water saturation of the snow, the stronger the resulting bond.

Unlike most other artificial ice construction techniques, such as flooding and spraying, the build-up rate for an ice structure constructed from ice blocks is not strongly dependent on the water freezing rate and the weather conditions, i.e., the blocks are already frozen. Because the ice blocks are cured to near ambient temperature, the water used to cement the blocks together also freezes rapidly. Thus, the build-up rate is largely governed by the rate at which the blocks are mined from the ice sheet, cured, and transported and positioned at the site. In the arctic area, island construction will most likely take place during the latter part of November and all of December and January. During this period, the ice will increase in thickness from 2 to 4 feet and have an average thickness of about 3 feet.

In addition to a high build-up rate, ice block structures also have the advantage of lower initial ice temperature and salinity than flooded ice. Under typical winter conditions, the sea ice blocks have an average temperature of about −10° C. and an average salinity of about 6 parts per thousand. In contrast, newly flooded ice constructed from the same sea water has a temperature close to its melting point −2° C. and an average salinity of about 30 parts per thousand. The sea ice blocks are therefore much stronger. The strength of the ice blocks can be further increased by allowing additional time to cure.

As we stated above, in addition to requiring sufficient ice strength to resist ice movement, an ice island must be large enough to have sufficient sliding resistance on the sea floor to prevent movement. The following is an approximation for H the ice island thickness:

$$H > \frac{4\sigma_c h}{\pi \rho_i D \tan\phi} + \frac{\rho_w}{\rho_i} d \quad (1)$$

where $\sigma_c$=unconfined compressive sea ice strength,
h=sea ice thickness,
D=ice island diameter,
d=water depth,
$\rho_i$=constructed ice density (57 pcf),
$\rho_w$=sea water density (64.3 pcf), and
$\phi$=friction angle of ice on sea floor.

While the above description has been made in great detail, various modifications can be made thereto without departing from the spirit or scope of the invention.

What is claimed is:

1. A method of constructing an artificial ice island in subfreezing temperature in a marine body having a natural ice sheet of sea water thereon which comprises:

constructing a lower level of fresh water ice by adding fresh water to a selected area of said ice sheet to form additional constructed ice until the bottom of the ice sheet in the selected area contacts bottom;

providing an insulation material to the top of said lower level of constructed fresh water ice providing an impervious layer on either side of the insulation material;

fabricating an upper construction layer of ice by adding sea water on top of said insulation and impervious layer, said impervious layer preventing brine from said upper construction layer from deteriorating said fresh water ice.

2. A method as defined in claim 1, in which the ice island thickness H and ice island diameter D has the following relationship:

$$H > \frac{4\sigma_c h}{\pi \rho_i D \tan\phi} + \frac{\rho_w}{\rho_i} d \quad (1)$$

where $\sigma_c$=unconfined compressive sea ice strength,
h=sea ice thickness,
D=ice island diameter,
d=water depth,
$\rho_i$=constructed ice density (57 pcf),
$\rho_w$=sea water density (64.3 pcf), and
$\phi$=friction angle of ice on sea floor.

3. In a method as defined in claim 1 in which fabricating the upper construction layer includes the steps of cutting ice blocks from the surrounding ice sheet, cooling said ice blocks at ambient temperature while positioned in a manner to permit drainage of concentrated brines and then placing said drained and cooled ice blocks on top of said insulation and impervious layer.

4. A method of constructing an artificial ice island in subfreezing temperature in a marine body having a natural ice sheet of seawater thereon which comprises:

constructing a lower level of ice by adding water to a selected area of said ice sheet to form constructed ice until the bottom of the ice sheet in the selected area contacts bottom;

building an upper construction layer of ice by cutting ice blocks from the surrounding ice sheet;

cooling said ice blocks to ambient temperature while in a position to permit drainage of brine from such blocks during cooling;

then placing said blocks on top of said lower level of ice.

* * * * *